US006305814B1

(12) United States Patent
Giamas

(10) Patent No.: US 6,305,814 B1
(45) Date of Patent: Oct. 23, 2001

(54) KEYHOLE LIGHTING FIXTURE

(76) Inventor: William Giamas, 45 Pemberton St., Cambridge, MA (US) 02140

( * ) Notice: Subject to any disclaimer, the term of this patent is extended or adjusted under 35 U.S.C. 154(b) by 0 days.

(21) Appl. No.: 09/448,561

(22) Filed: Nov. 23, 1999

Related U.S. Application Data

(60) Provisional application No. 60/122,419, filed on Mar. 2, 1999.

(51) Int. Cl.[7] ..... E05B 15/08

(52) U.S. Cl. ..... 362/100; 362/501; 362/276; 362/802; 362/800

(58) Field of Search ..... 362/100, 501, 362/276, 802, 800

(56) References Cited

U.S. PATENT DOCUMENTS

| | | | |
|---|---|---|---|
| 4,281,368 | 7/1981 | Humbert | 362/100 |
| 4,293,894 | 10/1981 | Blank | 362/100 |
| 4,310,873 | 1/1982 | Bean | 362/100 |
| 4,745,527 | 5/1988 | Belverio | 362/100 |
| 5,057,975 | 10/1991 | Evigan | 362/100 |
| 5,634,710 | 6/1997 | DiRusso | 362/100 |
| 5,996,383 * | 12/1999 | Adelmeyer et al. | 362/100 |

OTHER PUBLICATIONS

The Colombia Encyclopedia.Sixth Edition, Photoelectric cell.*

Mototrola Optoelectronics Device Data Catalog, Fifth Printing 1989.*

* cited by examiner

*Primary Examiner*—Stephen Husar
*Assistant Examiner*—Anabel Ton
(74) *Attorney, Agent, or Firm*—Gary E. Lambert; Edward Timmer

(57) ABSTRACT

An improved apparatus for illuminating keyholes comprised of an annular top housing made of rigid material, having recessed and through holes, and a recessed oval pocket having within two through holes. Top housing (12) is slidably over an annular bottom housing (30) made of the same material as top housing (12), also having recessed and through holes. A printed circuit board (40) having transistor (52), resistor (54), and male power connector (64), mounted and soldered directly on its surface, is housed and affixed within top housing (12), by screw (46), plastic spacer (44), and nut (48). A photoresistor (56) is housed within a pocket (20) and located on top housing (12), its two leads are inserted through two holes (22), located within pocket (20), and soldered directly to printed circuit board (40). A light emitting diode (58), positioned a predetermined distance below a keyhole, and having its two leads soldered to printed circuit board (40), is also housed within top housing (12). Battery (60), housed within top housing (12), provides power to printed circuit board (40) by plugging a female connector (66) into a male connector (64). An electronic circuit (50), powered by battery (60), controls and switches "ON" light emitting diode (58) to illuminate a keyhole from dusk to dawn. One through hole (26), located on opposite sides of top housing (12), and one tapped through hole (36), on opposite sides of bottom housing (30), facilitates insertion of a 2-56 screw (46) on each side to secure top housing (12), which is mounted over bottom housing (30), firmly in place.

16 Claims, 11 Drawing Sheets

KEYHOLE LIGHTING FIXTURE

This application claims benefit of Prov. No. 60/122,419 filed Mar. 2, 1999.

BACKGROUND—FIELD OF INVENTION

This invention relates to an apparatus and the circuitry used to automatically switch and control the illumination of a keyhole.

BACKGROUND—DESCRIPTION OF PRIOR ART

Previous keyhole illuminating devices were designed for mounting adjacent to a keyhole. Although these devices provide illumination for a keyhole, they have an objectionable feature in that, the illuminating apparatus and the cylinder are mounted apart from each other. Because of this separation, the light emitted from the source is scattered and may improperly illuminate a keyhole. Additionally, these devices do not provide any means for activating the illumination automatically, human intervention is required.

Each prior art cited has its own distinct feature and is successful in illuminating a keyhole. However, they have other drawbacks in the method used to initiate the illumination process. First, a contact switch must be pressed in the dark, an inconvenient task indeed, before illumination can occur. Second, since the illumination is cycled, this switch must be pressed repeatedly if the duration is insufficient.

U.S. Pat. No. 5,634,710 to DiRusso and Tarlow (1996) disclosed a keyhole light made up of three elements, an electroluminescent light display, an electronic module, and a conductive switch panel. Although this apparatus illuminates a keyhole, it has an objectionable feature in that, all parts with the exception of the electronic module, are susceptable to damage because, they are exposed and not concealed within an enclosure. Double sided adhesive tape used to hold parts on a surface is not reliable for long term use.

U.S. Pat. No. 4,310,873 to Bean (1980) shows a structure positioned above a lock cylinder and door knob. Although there is illumination provided for the keyhole, it has a drawback in the way the illumination is projected in illuminating a keyhole. The illumination is pointed downwards on top of the lock cylinder, casting a shadow, which may not properly illuminate the keyhole. The duration of illumination provided by the timing circuit, may be insufficient to allow for key insertion.

Another U.S. Pat. No. 4,281,368 to Humbert (1979), proposes a keyhole illuminating apparatus comprising of an elongated tubular housing adapted for mounting on a surface adjacent a keyhole, uses a light bulb which is actuated by tightening a translucent cap to make contact with the positive terminal of the battery.

The three references cited above have a common drawback in that, the illumination of a keyhole depends on an inconvenient and difficult task of finding a contact switch to be pressed, in dark or subdued lighting conditions.

My invention is unique in that, it eliminates manual switching, an illuminated keyhole is readily available in either dark or subdued lighting conditions for key insertion. The illumination for a keyhole is automatically activated and deactivated at prescribed times.

The disadvantages of my invention which describes a keyhole lighting fixture are:

(a) The brass material from which the keyhole lighting fixture is made, is expensive to purchase and manufacture. However, other materials such as various plastics can be used to reduce cost of manufacturing significantly.

(b) The printed circuit board, light emitting diode, and wiring are all housed within the keyhole lighting fixture's top housing, this results in overcrowding because of the limited space which is available, it does not however limit the scope and purpose for its use.

OBJECTS AND ADVANTAGES

Accordingly, several objects and advantages of the present invention are:

(a) to provide unobstructed access of a keyhole for key insertion;

(b) to provide control and automatically illuminate a keyhole only at prescribed times, thereby conserving energy and extending battery life;

(c) to provide simultaneous control and sufficient illumination by a circuit designed for low voltage operation;

(d) To provide sufficient illumination by using a low current light source such as a Light Emitting Diode (LED);

(e) To provide easy installation of the keyhole lighting fixture on a door surface with only a screw driver;

(f) Human intervention is reduced to just changing a battery only when the need arises.

(g) Has a very pleasing character shape.

Further objects and advantages are, to simplify battery replacement without the need to disassemble the keyhole lighting fixture, and reduce the frequency of battery replacement by using a high energy battery. Redesign the present keyhole lighting fixture to accept rechargeable batteries, that have an advantage over standard batteries in that, the same batteries are used repeatedly by recharging them in a charger. Rechargeable batteries, unlike standard batteries, are more convenient to use, and results in savings to the consumer. To design a circuit which would detect movement in the proximity of a keyhole, and illuminate it only when a dark condition is satisfied. Still further objects and advantages will become apparent from a consideration of the ensuing description and drawings.

BRIEF DESCRIPTION OF DRAWING FIGURES

REFERENCE NUMERALS IN DRAWINGS

| | |
|---|---|
| 10 keyhole lighting fixture | 12 top housing |
| 14 recessed hole | 16 groove |
| 18 center through hole | 20 pocket |
| 22 pocket through holes | 24 countersunk through hole |
| 26 mounting through holes | 30 bottom housing |
| 32 recessed through hole | 34 centering through hole |
| 36 mounting through holes | 40 printed circuit board |
| 42 pcb through hole | 44 plastic spacer |
| 46 2-56 screw | 48 2-56 nut |
| 50 electronic circuit | 52 switching transistor |
| 54 resistor | 56 photoresistor |
| 58 light emitting diode | 60 3 volt lithium battery |
| 62 ground | 64 male power connector |
| 66 female power connector | 86 keyhole |
| 88 lock cylinder | 90 ring |

SUMMARY OF INVENTION

In accordance with the present invention a keyhole lighting fixture comprises, an annular top housing, a printed circuit board with components affixed within top housing, and an annular bottom housing affixed to the top housing with two screws.

DESCRIPTION-FIGS. 1 TO 4

Figure 1:
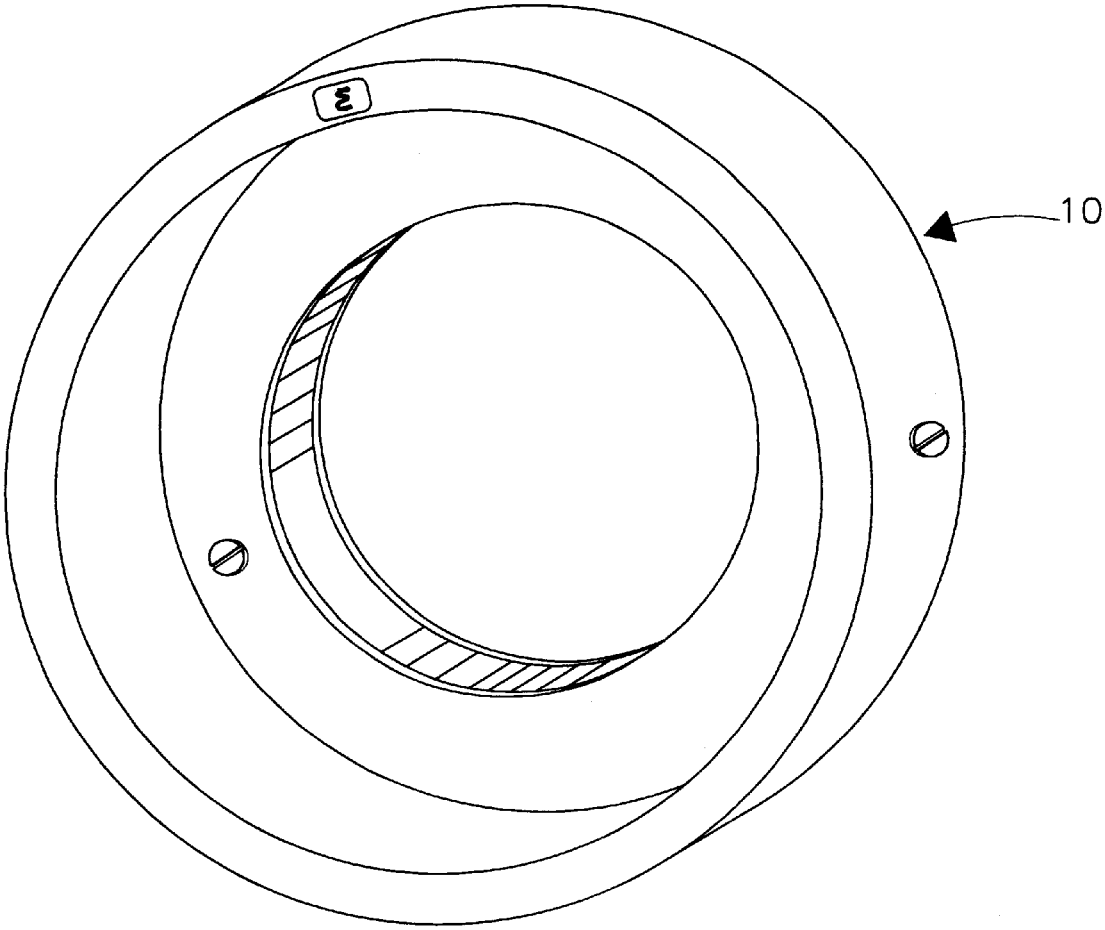
FIG. 1 shows an isometric view of a keyhole lighting fixture as it appears when assembled into a complete structure.

A preferred embodiment of the keyhole lighting fixture of the present invention in use, is shown in FIG. 1 (isometric view). FIGS 1A–1E show the geometry of a top housing, FIGS. 2A–2E show the geometry of a bottom housing, and FIGS. 3A–3F show the geometry of a printed circuit board.

Figure 1A:
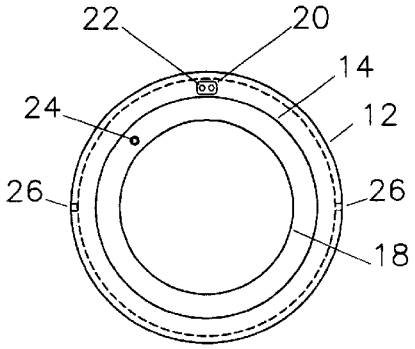
FIGS. 1A to 1E show various aspects of a top housing, including the location of a pocket and pocket through holes.
Figure 1B:
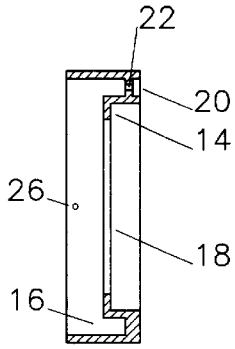
Figure 1C:
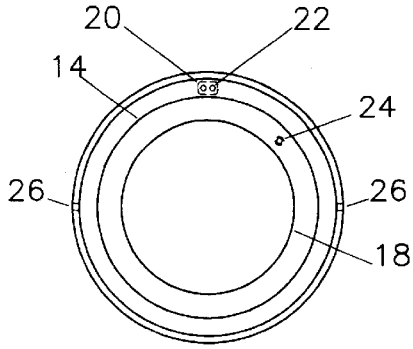
Figure 1D:
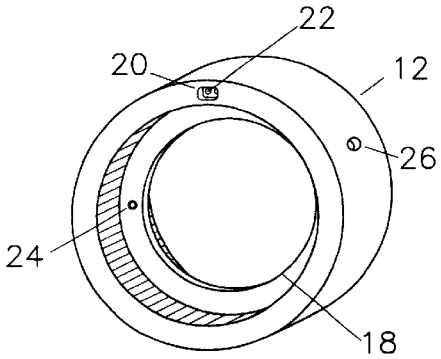
Figure 1E:
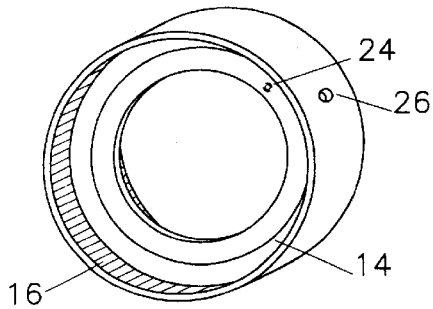

The keyhole lighting fixture 10 FIG. 1, has an annular top housing 12 FIGS. 1A–1C, with an outside diameter of 2.5 inches, a width of 0.69 inches, a wall thickness of 0.062 inches, a hole 14 having a diameter of 1.9 inches recessed to a depth of 0.22 inches, and a center through hole 18 having a diameter of 1.5 inches. A 0.26 inch wide groove 16 FIG. 1B is located between the wall thickness and the circumference of recessed hole 14. An oval pocket 20 FIG. 1A, 0.20 inches×0.16 inches recessed to a depth of 0.10 inches, is centered between the inner wall of top housing 12 FIG. 1C, and the circumference of recessed hole 14.

Figure 7:
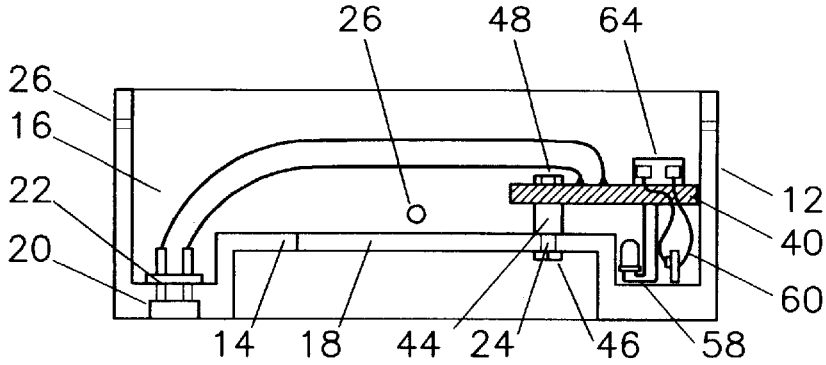
FIG. 7 shows a cross-sectional view of the top housing, printed circuit board with components, and hardware used for mounting.

Referring to FIG. 7, two through holes 22 within pocket 20 having equal diameters of 0.078 inches, are 0.125 inches on center, also located on the top housing 12, terminate at groove 16.

A countersunk through hole 24, FIG. 1A, is centered at an angle of 45 degrees between recessed hole 14 and center through hole 18. Two through holes 26 having equal diameters on the side of top housing 12, are 180 degrees apart horizontally when top housing 12 is installed.

Figure 2A:
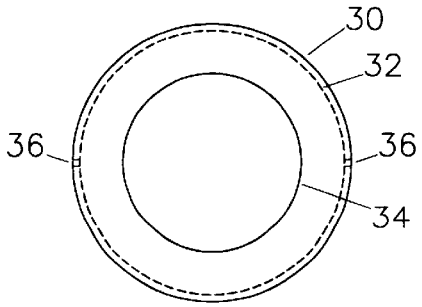
FIGS. 2A to 2E show various aspects of a bottom housing, including location of through holes.

In the preferred embodiment top housing 12 FIG. 1A and bottom housing 30 FIG. 2A, can be made from brass stock and machined to specified dimensions. Materials such as pvc, polyethylene, polypropylene, can also be used to reduce cost of manufacturing.

Figure 2B:
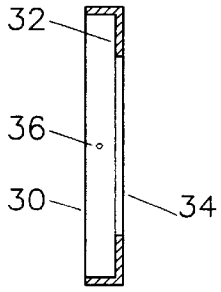
Figure 2C:
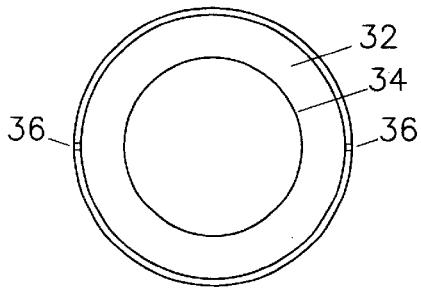
Figure 2D:
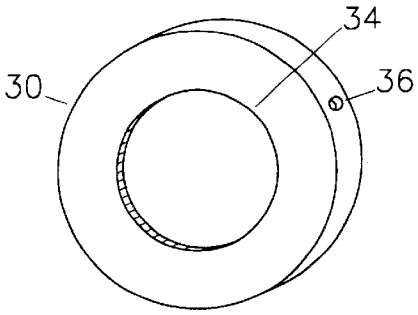
Figure 2E:
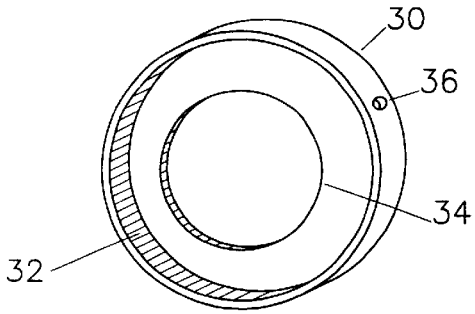

Bottom housing 30 is illustrated in FIG. 2A (top view), FIG. 28 (side view), FIG. 2C (bottom view), FIGS. 2D–2E are illustrated in (isometric views).

As shown in FIGS. 2A–2C, bottom housing 30, has an outside diameter of 2.4 inches, a width of 0.25 inches, a wall thickness of 0.062 inches, a 2.3 inch diameter hole 32 recessed to a depth of 0.18 inches, and a centering through hole 34 having a diameter of 1.37 inches. Two through holes 36 on the side of bottom housing 30 having equal diameters, are tapped for a 2-56 screw, and are always located 180 degrees apart on a horizontal plane when bottom housing 30 is installed.

Figure 9:
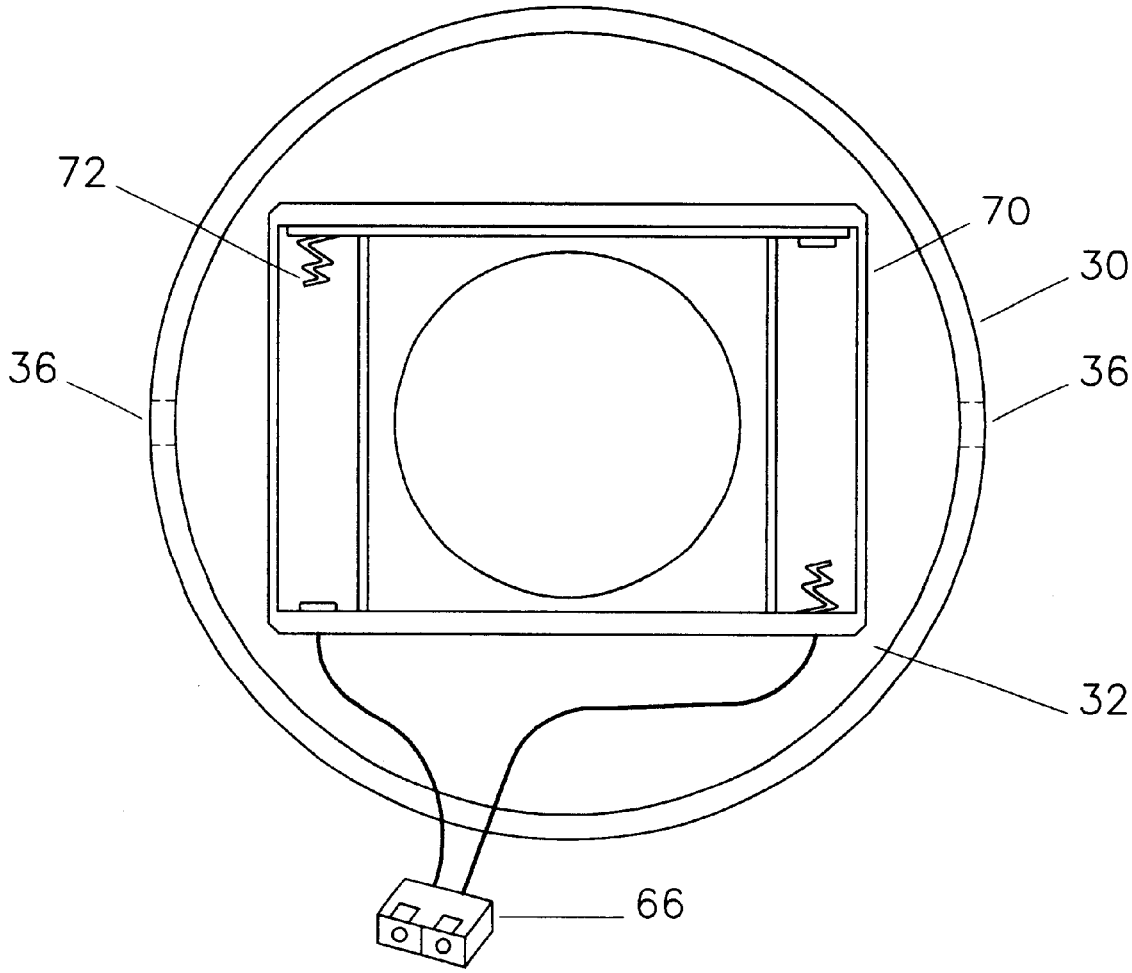
FIG. 9 shows a top view of an improved design of the bottom housing a battery holder for two AAA batteries.
Figure 10A:
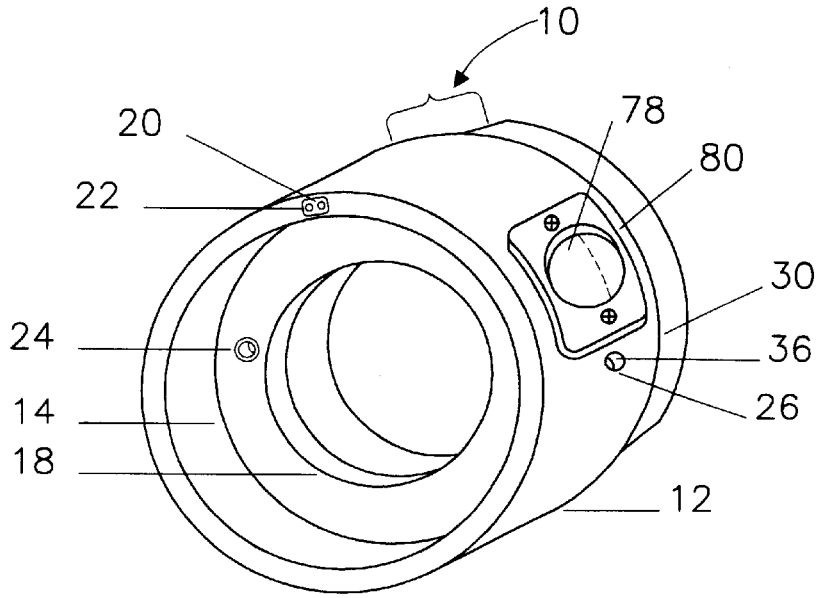
FIG. 10 shows an improved design of the top and bottom housings, allowing a high energy battery with no attached leads to be installed, thereby eliminating disassembly of the keyhole lighting fixture and connectors.
Figure 10B:
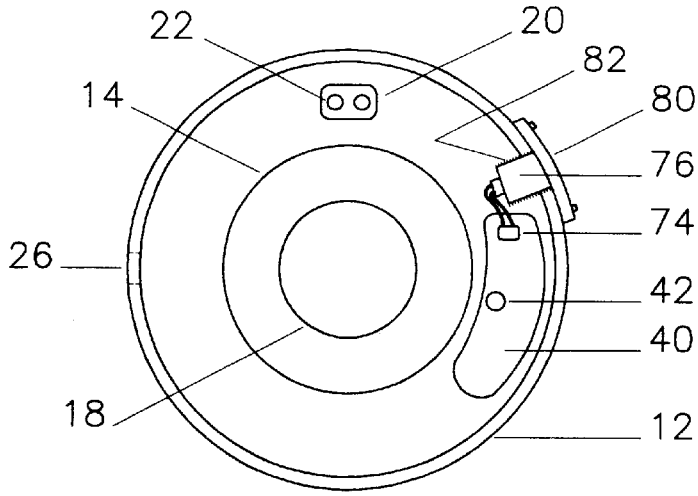

Additional embodiments of the keyhole lighting fixture 10, are shown in FIGS. 9 and FIG. 10. As shown in FIG. 9 bottom housing 30 has been modified to include a battery holder 70 for two AAA batteries. FIG. 10A and FIG. 10B show a another modified embodiment of the present top housing 12 and bottom housing 30, which when joined together, allow a high energy battery 76 to be inserted externally thus, eliminating disassemby of keyhole lighting fixture 10 to replace a battery.

Figure 3A:
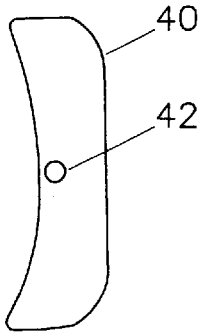
FIGS. 3A to 3F show various aspects and configuration of a printed circuit board.
Figure 3B:
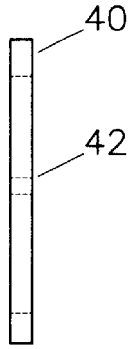
Figure 3C:
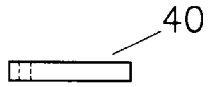
Figure 3D:
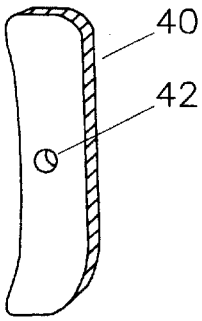
Figure 3E:
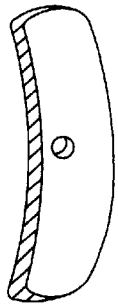
Figure 3F:
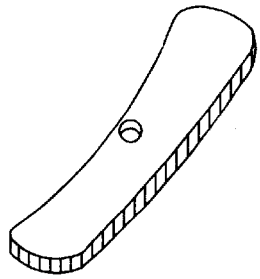

Printed circuit board 40 is illustrated in FIG. 3A (top view), FIG. 3B (side view), FIG. 3C (end view), FIG. 3D, FIG. 3E, and FIG. 3F are all isometric views.

Printed circuit board 40 FIG. 3A, has an inner arc with a radius of 1.37 inches, and two outer arcs with equivalent radii of 0.37 inches, there is also a through hole 42 drilled for a 2-56 screw. Material used for printed circuit board 40 presently comprises of a phenolic substrate however, epoxy substrate can also be used.

Figure 4:
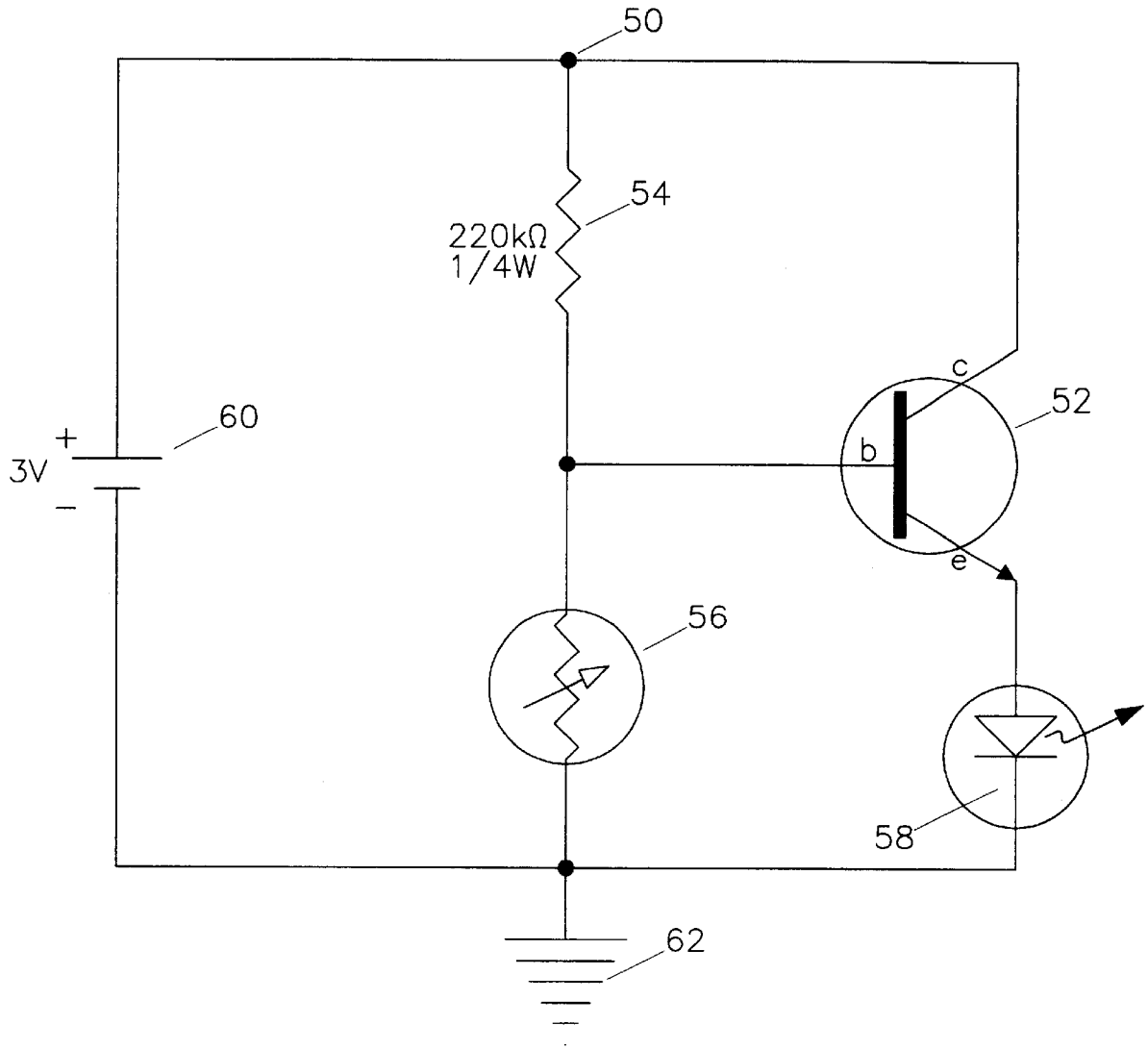
FIG. 4 shows the schematic diagram of a circuit used to control and illuminate a keyhole.
Figure 5:
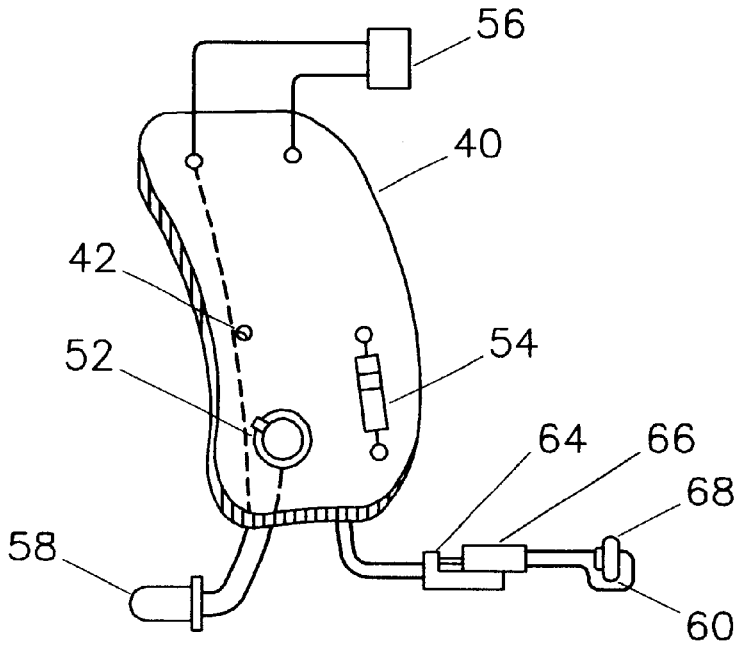
FIG. 5 shows a printed circuit board and the physical layout of components and connections to a light emitting diode, battery, and photoresistor. The shape of the printed circuit board necessary for installation is also shown.

The schematic diagram of the electronic circuit is shown in FIG. 4. The circuit 50, controls illumination of a keyhole by switching light emitting diode 58, to illuminate keyhole 86 FIG. 11, from dusk to dawn, and allow quick insertion of a key to unlock a door.

Components making up electronic circuit 50 are, switching transistor 52, resistor 54, photoresistor 56, light emitting diode 58, battery 60, male power connector 64, and female power connector 66.

Switching transistor 52 is a 2N2222A, resistor 54 has a value of 220 kohm and rated for ¼ watts. Photoresistor 56 is made from cadmium sulfide (Cds) material, light emitting diode 58 is a general purpose device which emits yellow light when power is applied, battery 60 is a 3 volt lithium battery, and connectors 64 and 66 are male and female Burg connectors.

From the description above, a number of advantages of my keyhole lighting fixture 10 become evident:

(a) Provides unobstructed access for key insertion and illuminates a keyhole automatically from dusk to dawn.

(b) Eliminates scattering and enhances the illumination of a keyhole by confining and concentrating light emitted from a source to within a sealed enclosure.

(c) The electronic circuit consumes low power by incorporating solid state devices, and provides sufficient illumination for a keyhole.

(d) Uses a standard 3 volt lithium battery, for circuit operation, and lasts much longer than a typical alkaline battery.

(e) A light emitting diode, lasting much longer than a light bulb, is used as a source of light for illuminating a keyhole.

(f) It provides easy installation and replacement of a battery, by connecting or disconnecting a connector.

(g) The printed circuit board with components housed within the top housing is easy to install and replace.

(h) The keyhole lighting fixture is easy to install and disassemble, only a screw driver is required.

Figure 8:
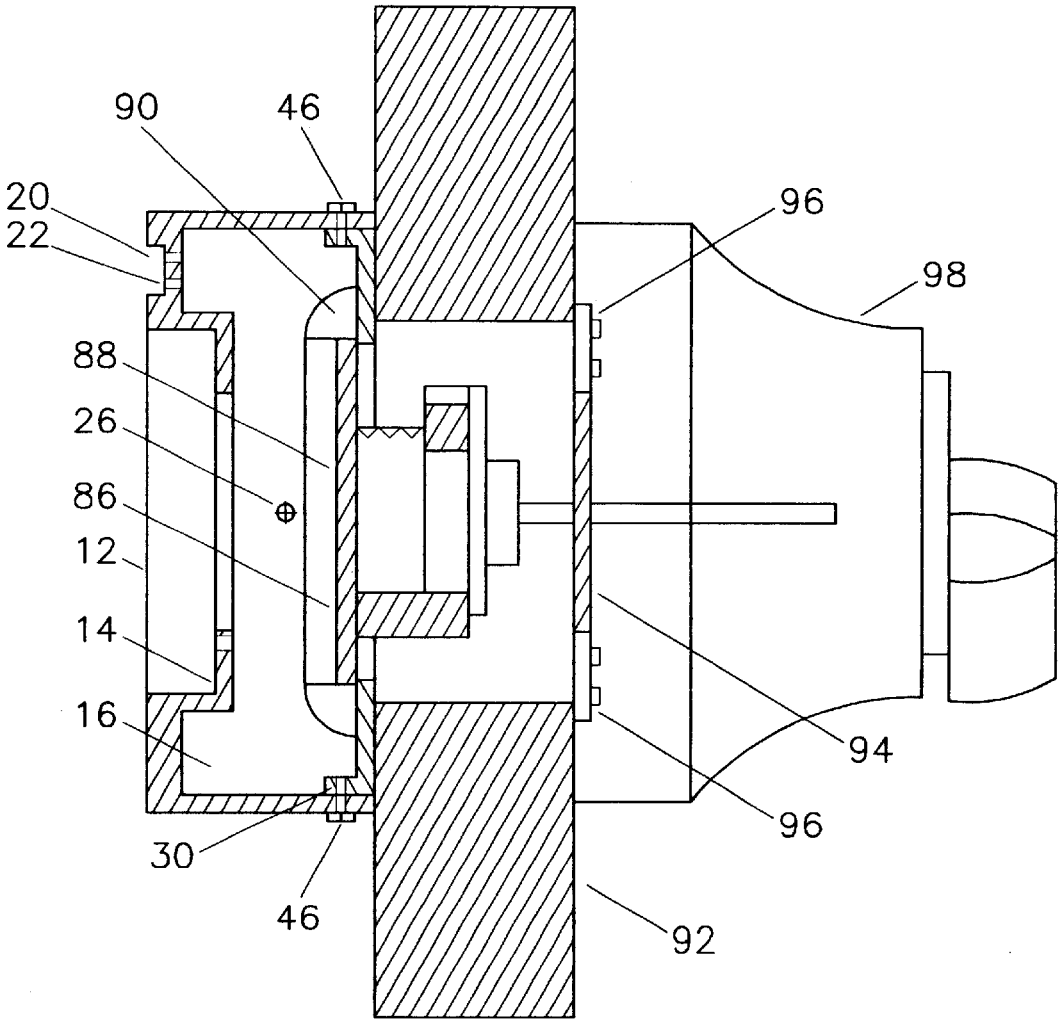
FIG. 8 shows a cross-sectional view of the top housing and bottom housing installed on a door surface, along with accompanying Rim Deadlock, and lock parts such as, lock cylinder, ring, lock, etc.
Figure 11:
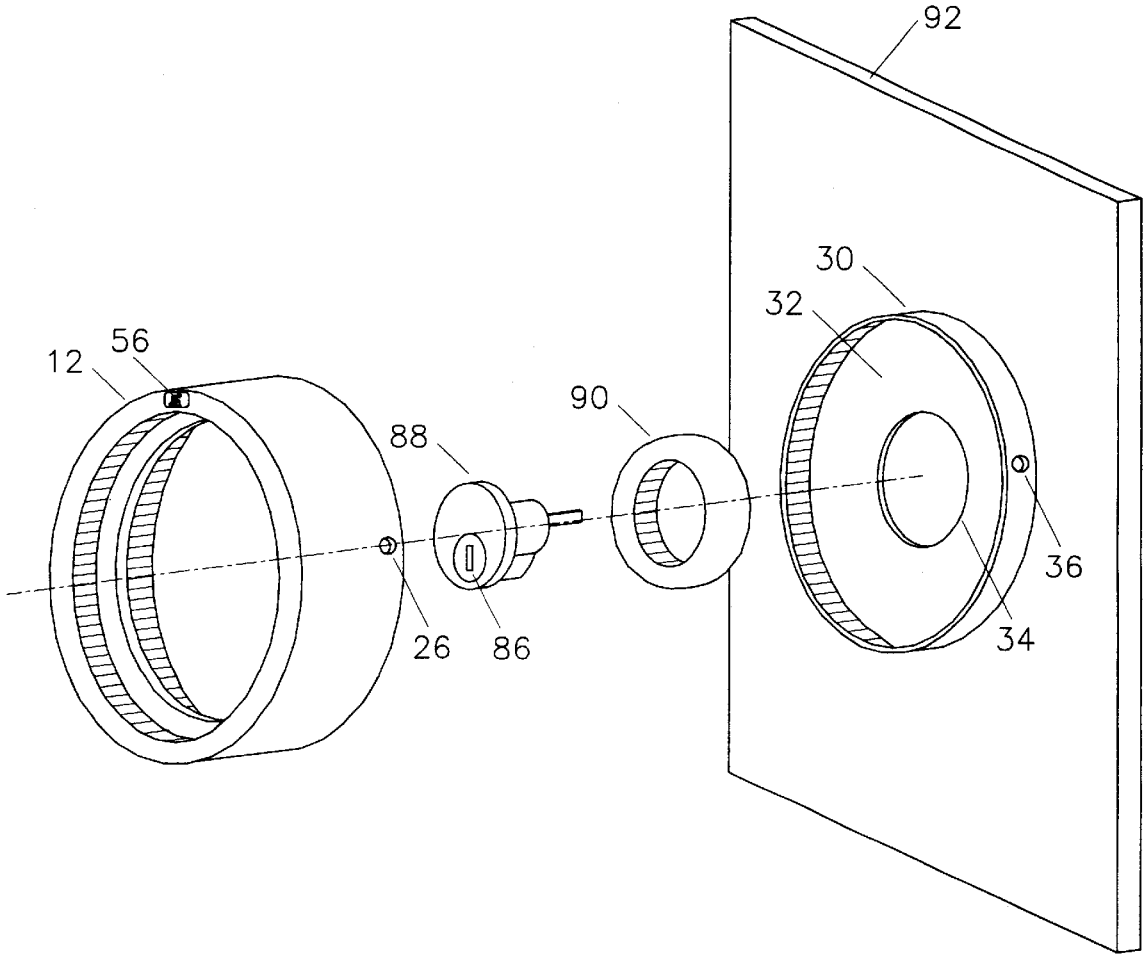
FIG. 11 shows the positioning in isometric views of the top housing look cylinder, ring, bottom housing, and door surface upon which they are mounted.

OPERATION—FIGS. 1, 2, 3, 4,

The keyhole lighting fixture 10, shown in FIG. 1 and FIG. 8, is used with Rim Deadlocks, Jimmyproof Locks, or locks with similar cylinders. Installation of the keyhole lighting fixture 10 is described below:

Recessed hole 32 of bottom housing 30 FIG. 2 and FIG. 11, provides a surface for mounting cylinder 88 and ring 90. Cylinder 88 is inserted in ring 90 and through centering hole 34. Bottom housing 30 FIG. 11, having cylinder 88 and ring 90 positioned within, is mounted first on the front surface of door 92, and secured in place by steel plate 94 shown in FIG. 8, and two screws 96, inserted from the rear of door 92. Lock 98 is then mounted and secured with four wooden screws.

Figure 12:
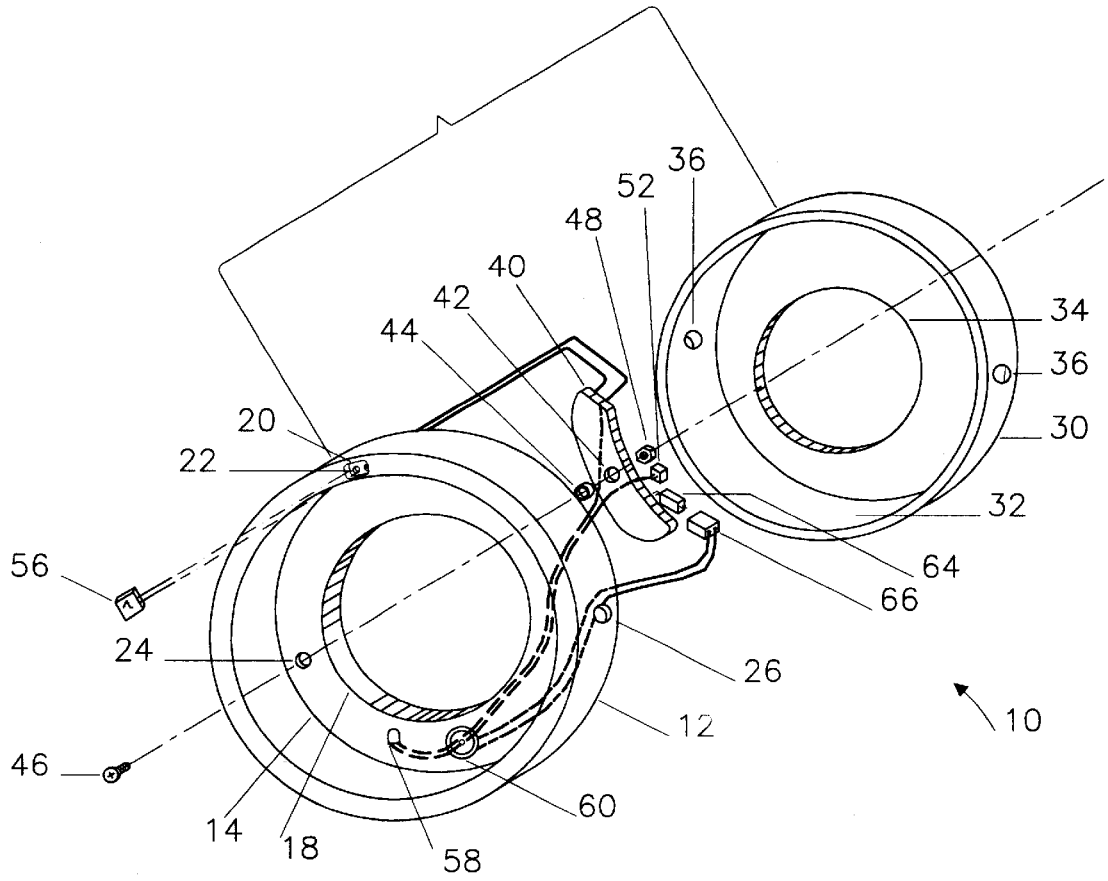
FIG. 12 is an exploded view showing various parts for assembly of the keyhole lighting fixture into a complete structure.

As shown in FIG. 12, two through holes 36, tapped for a 2-56 screw on the left and right sides of bottom housing 30, fix a position for photoresistor 56 which is at an angle of 90 degrees with respect to the position of the two through holes 36.

They are also used, as shown in FIG. 8, to secure bottom housing 30 to top housing 12 with two 2-56 screws 46.

Figure 6:
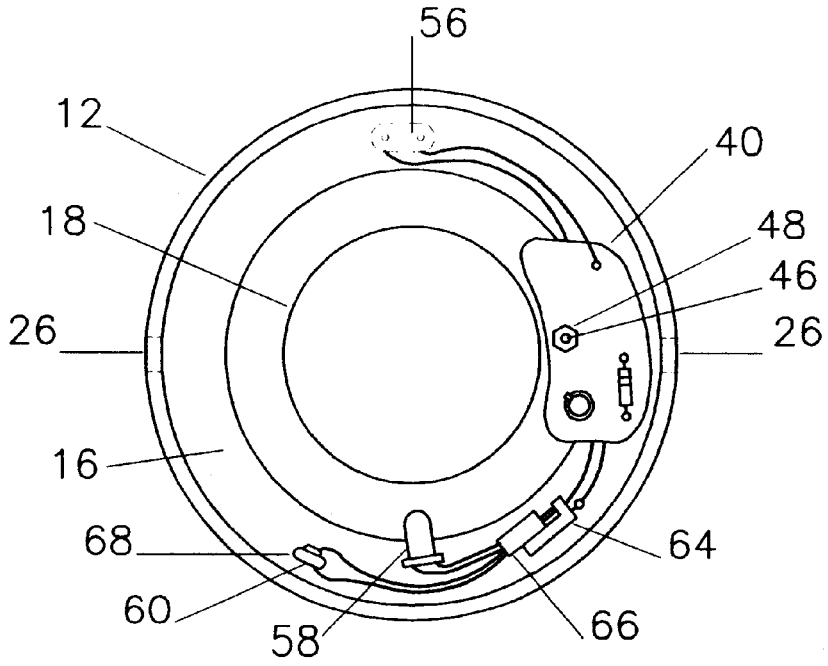
FIG. 6 shows a bottom view of the top housing, including a printed circuit board with components mounted, connections to a battery, light emitting diode, and photoresistor, all positioned within.

As shown in FIG. 6, top housing 12, houses printed circuit board 40 with components, photoresistor 56, light emitting diode 58, battery 60, and connectors 64 and 66. Photoresistor 56 and light emitting diode 58 are soldered on printed circuit board 40. Battery 60 supplies power to printed circuit board 40 by a female connector 66 plugged into a male connector 64 soldered onto printed circuit board 40.

FIG. 8 shows a cross section of top housing 12, mounted over bottom housing 30. A 2-56 screw on each side is inserted in holes 26 and 36 and tightened with a screwdriver, to hold top housing 12 and bottom housing 30 firmly in place. When top housing 12 is installed, the lens top of light emitting diode 58 FIG. 7, is 0.375 inches below keyhole 86. Light emitting diode 58, is concealed within top housing 12 and does not interfere with insertion of a key in keyhole 86.

Printed circuit board 40 FIG. 7, with components is positioned and secured within bottom of top housing 12. A countersunk through hole 24 FIG. 1A, located at an angle of 45 degrees, centered between recessed hole 14 FIG. 1C, and center through hole 18 FIG. 1C, allows insertion of a 2-56 flathead screw 46 FIG. 7, through plastic spacer 44, printed circuit board 40, and tightened with 2-56 nut 48.

A holder 70 FIG. 9, molded for two AAA batteries for bottom housing 30, simplifies battery replacement. A metal contact 72 connects both batteries in series, and connector 66 applies power to printed circuit board 40 FIG. 6. As shown in FIG. 10A, (isometric view), top housing 12 and bottom housing 30 have semi-circular notches, which when joined form an aperature 78, to allow insertion of a 3 volt high energy battery 76, which lasts much longer than a standard lithium battery.

Also shown in FIG. 10B is a (bottom view) of top housing 12, whereby the positive terminal of battery 76 engages with a spring loaded metallic contact 74 on printed circuit board 40, and the negative terminal engages with a brass cover 80, which serves as a return path and ground, similar to a car's battery, which also has its negative terminal grounded to the metal frame of the engine. Insulated sleeving 82 on the edges of top housing 12 and bottom housing 30 keeps battery 76 from shorting with the surrounding metal surface.

The electronic circuit 50 FIG. 4, and theory of operation is now described below:

To keep from shorting, battery 60 FIG. 6, is insulated with sleeving 68. Referring to FIG. 4, power is applied to one side of resistor 54 and to the collector of switching transistor 52. Resistor 54 referred to as a bias resistor, provides current to the base of switching transistor 52 to produce a nominal value of 0.6 volt drop from base to emitter thus, causing switching transistor 52 to conduct.

The other side of resistor 54 is connected to the base of transistor 52 and one side of photoresistor 56. The photoresistor's resistance varies according to changing light conditions, from 100 ohms during daylight hours to more than one million ohms (1 Mohms) when dark.

A junction which connects resistor 54, photoresistor 56, and base of transistor 52, forms a voltage divider. The output voltage from this junction is applied to the base of transistor 52.

The other side of photoresistor 56, is connected to the cathode of light emitting diode 58, negative side of battery 60, and ground. The emitter of transistor 52, is connected to the anode of light emitting diode 58. When the photoresistor's resistance is 100 ohms, the output voltage from the voltage divider is 0.001 volts, or 1 millivolt (1 mv).

Transistor 52 is now turned "OFF" and does not conduct, light emitting diode 58 is now extinguished. A minuscule amount of current does flow through the series combination of resistor 54 and photoresistor 56 to ground 62 however, but not enough for transistor 52 to conduct.

With transistor 52 turned "OFF", the current which flows through resistor 54 and photoresistor 56 is calculated by using Ohm's Law.

From the equation $V=I\times R$, the current $(I)=V/R$. The total resistance $Rt=(Rb+RcDs)=(220\text{ kohms}+100\text{ ohms})=220.1$ Kohms. The current $(I)=V/Rt=3.0\text{ v}/220.1\text{ Kohms}=0.000013$ amperes.

When the photoresistor's resistance is one million ohms (1 Mohm), the output voltage is calculated by the voltage divider equation which is: $V(out)=V\times RcDS/(Rb+RcDs)$, substituting values we have, $V(out)=3.0\times 1{,}000{,}000\text{ ohms}/(22{,}000\text{ ohms}+1{,}000{,}000\text{ ohms})=2.45$ volts, and appears between the base of transistor 52 and ground 62.

Referring to FIG. 4, A voltage drop of 0.6 volts between the base and emitter, causes emitter current to flow and transistor 52 conducts. Light emitting diode 58 is illuminated by the emitter current which flows through it, and produces a voltage drop of 1.85 volts across its junction. This voltage drop of 1.85 volts forward biases light emitting diode 58, and is the difference between 2.45 volts and 0.6 volts.

Conclusion, Ramifications, and Scope

Accordingly, the reader can see that the keyhole lighting fixture of this invention can be used to illuminate a keyhole easily and conveniently.

It can be installed and removed easily without damage to any individual part, including the printed circuit board and components.

In addition, most parts, with the exception of photoresistor 56, cylinder 88 and ring 90, are concealed within a solid enclosure and cannot be damaged by mishandling. One opening, a center through hole 18, FIG. 1A, allows access to keyhole 86 FIG. 8, for key insertion. Furthermore, the keyhole lighting fixture has additional advantages in that

- it enhances the illumination of a keyhole, by confining and concentrating internally light emitted from a source within a boundary defined by the area of the keyhole lighting fixture.
- it does not allow scattering of light because, it is concentrated within a uniform sealed area to only illuminate a keyhole. The only escape route for light is an opening provided by a center through hole located on the top housing.
- it permits easy installation and replacement of a battery by removing the top housing from the bottom housing, and connecting or disconnecting a female connector from a male connector hard wired on a printed circuit board.
- it allows the use of a standard 3 volt lithium battery which lasts much longer than a standard alkaline battery, and is readily available worldwide.
- it allows a printed circuit board with components, housed in the top housing to be easily installed and replaced.
- it allows an electronic circuit, which uses low power solid state devices to provide control of illumination.

Although the description above contains many specificities, these should not be construed as limiting the scope of the invention but as merely providing illustrations of some of the presently preferred embodiments of this invention.

For example, the keyhole lighting fixture can have other shapes and still maintain its annular structure, a mold to facilitate mounting of two AAA batteries in the bottom housing, semicircular notches on one side of the top and bottom housings, which when joined together form an aperature to facilitate the installation of a high energy battery thus, eliminating the need to remove the top housing in order to replace the battery.

The electronic circuit can be modified to have an adjustment for controlling the brightness of the light emitting diode, simply by adding a variable resistor.

Additionally, to conserve more battery power, the same circuit could be modified to include a timing circuit for cycling the illumination. For example, such a circuit, would allow the duration for illuminating a keyhole to be adjustable as the need arises.

It is understood that while the keyhole lighting fixture has been described for use as an illuminator for keyholes, modifications can be made, whereby the illumination may be equally applicable to other areas such as, street numbers, automobile ignition switches, automobile safety seat buckles, and electrical wall switches.

Thus the scope of the invention should be determined by the appended claims and their legal equivalents, rather than by the examples given.

I claim:

1. A keyhole lighting fixture comprising of:

an annular rigid structure having a top housing slidable over an annular bottom housing having the same rigid structure, wherein said keyhole lighting fixture houses a printed circuit board occupied with components, wherein the printed circuit board is connected to a battery, a light emitting diode, and a photoresistor, and wherein the light emitting diode is activated upon dark ambient light condition and deactivated upon illuminated ambient light condition.

2. The keyhole lighting fixture of claim 1 wherein said body of material is composed of brass.

3. The keyhole lighting fixture of claim 1 wherein said top housing is an annular structure having a hole with a diameter which is less than the outside diameter and recessed to a predetermined depth which is less than one half the width, is located within said structure.

4. The keyhole lighting fixture of claim 3 wherein said top housing has a through hole having a diameter less than the recessed hole and same depth, said through hole is adjacent to said recessed hole and extends the full width of the wall thickness of said recessed hole.

5. The keyhole lighting fixture of claim 3 wherein said top housing having a countersunk through hole with a diameter considerably smaller, is adjacent and centered at an angle of 45 degrees between said recessed hole and said through hole.

6. The keyhole lighting fixture of claim 3 wherein said top housing having two through holes of equal diameters are 180 degrees apart are centered on the side, and extend the full width of the wall thickness.

7. The keyhole lighting fixture of claim 3 wherein said top housing having an oval pocket centered between the inner wall of said top housing and the circumference of said recessed hole, said pocket recessed to a predetermined depth extends a length equal to the wall thickness of said top housing.

8. The keyhole lighting fixture of claim 7 wherein said oval pocket having within two through holes of equal diameters, extend the full length of the wall thickness of said pocket.

9. The keyhole lighting fixture of claim 3 wherein said top housing houses a printed circuit board with components, a battery, a light emitting diode, and a photoresistor.

10. The keyhole lighting fixture of claim 1 wherein said bottom housing is an annular structure having a hole with a diameter less than the outside diameter and equal to the inside diameter, is recessed to a depth which extends a length equal to the wall thickness of said bottom housing.

11. The keyhole lighting fixture of claim 10 wherein said bottom housing has a through hole having a diameter less than the recessed hole, said through hole is adjacent to said recessed hole and extends the full width of the wall thickness of said recessed hole.

12. The keyhole lighting fixture of claim 10 wherein said bottom housing having two tapped through holes of equal diameters are 180 degrees apart, are centered on the side, and extend the full width of the wall thickness.

13. The keyhole lighting fixture of claim 3 wherein said top housing is slidable over said bottom housing.

14. The keyhole lighting fixture of claim 13 wherein said top housing is slidable over said bottom housing and affixed with two screws.

15. The keyhole lighting fixture of claim 9 wherein said top housing houses a printed circuit board, said printed circuit board has curved edges with different radii, and one through hole centered a predetermined distance from the inner edge of said printed circuit board.

16. The keyhole lighting fixture of claim 1 further comprising illumination means positioned within said top housing for illuminating a keyhole cylinder front face, power means supported by a battery, and switching means supported by an electronic circuit on said printed circuit board for controlling the illumination.

* * * * *